US005224143A

United States Patent [19]

Dumitrescu et al.

[11] Patent Number: 5,224,143

[45] Date of Patent: Jun. 29, 1993

[54] DIHEDRAL DEFLECTION CATHODE FOR AN X-RAY TUBE

[75] Inventors: Horia Dumitrescu, Guyancourt; Bernard Evain, Issy-Les-Moulineaux; Antoine Simeone, Montreuil, all of France

[73] Assignee: General Electric CGR S.A., Issy Les Moulineaux, France

[21] Appl. No.: 649,041

[22] Filed: Feb. 1, 1991

[30] Foreign Application Priority Data

Feb. 2, 1990 [FR] France ..... 90 01249

[51] Int. Cl.[5] ..... H01J 35/06

[52] U.S. Cl. ..... 378/136; 378/134; 378/138

[58] Field of Search ..... 378/136, 121, 134, 137, 378/138

[56] References Cited

U.S. PATENT DOCUMENTS 4,065,689 12/1977 Pleil ..... 378/134
4,685,118 8/1987 Furbee et al. ..... 378/138
4,823,371 4/1989 Grady ..... 378/134
4,870,671 9/1989 Hershyn ..... 378/134
4,894,853 1/1990 Dowd ..... 378/136

FOREIGN PATENT DOCUMENTS 0115731 8/1984 European Pat. Off. .
2538948 7/1984 France .

OTHER PUBLICATIONS

Patent Abstracts of Japan vol. 10, No. 184 (E-415) (2240) Jun. 27 1986 JP-A-61 32338 (Shimadzu Corp) Feb. 15 1986.

*Primary Examiner*—David P. Porta
*Assistant Examiner*—Kim-Kwok Chu
*Attorney, Agent, or Firm*—Cushman, Darby & Cushman

[57] ABSTRACT

The invention relates to X-ray tubes. The cathode for an X-ray tube has two filaments associated with a deflecting and focusing device which comprises at least three metal parts which are electrically insulated from one another and which are raised to electrical voltages. First and second ones of the metal, parts are associated with a first filament, while the second metal part and a third metal part are associated with the second filament.

7 Claims, 3 Drawing Sheets

DIHEDRAL DEFLECTION CATHODE FOR AN X-RAY TUBE

The invention relates to X-ray tubes, and more particularly to cathodes for such tubes making it possible to obtain at least two X-ray beams at the outlet from the tube, said beams having different characteristics of energy and geometry.

BACKGROUND OF THE INVENTION

Inside a vacuum enclosure, an X-ray tube comprises, a cathode constituted by a heated filament which emits electrons, and a focusing device backed onto the filament which focuses the emitted electrons onto an anode raised to a positive potential relative to the cathode. The point of impact of the electron beam on the anode constitutes the source of X-radiation in the form of a beam.

In order to deflect the X-ray beam angularly, proposals are generally made to displace the point of impact of the electron beam over the anode by using deflecting means. Such deflecting means are generally constituted by magnetic or electrostatic lenses which are disposed on the path of the beam or in the vicinity of said path between the cathode and the anode. Because of the high kinetic energy of the electrons in the beam, and their high speed given the high potential difference between the cathode and the anode (more than 100 kilovolts), using such lenses consumes a non-negligible amount of energy.

French patent number 2 538 948 proposes a scanning X-ray tube in which the focusing device includes at least two metal parts which are electrically insulated from each other and from the filament in order to enable them to be biased independently relative to the filament and thus deflect the electron beam.

FIG. 1 is a schematic view of an X-ray tube of the type described in the above-mentioned patent application. Inside a vacuum enclosure represented by a dashed line rectangle 11, it comprises a filament 12, a focusing device 13 backing onto the filament 12, and an anode 14. The filament 12 and the focusing device 13 constitute a cathode C1. The focusing device 13 is constituted by a first metal part 15 and a second metal part 16 which are electrically insulated from each other by an insulating partition 17 fixed to an insulating base 18. The metal parts 15 and 16 are disposed symmetrically on either side of the filament 12 about a plane of symmetry extending perpendicularly to the plane of FIG. 1. This plane of symmetry contains the axis of the filament 12 which extends perpendicularly to the plane of FIG. 1, and is perpendicular to the base 18. The axis 19 of the electron beam is defined by the intersection of said plane of symmetry with the plane of FIG. 1.

When equal voltages are applied to the metal parts 15 and 16, the cathode C1 emits an electron beam F along the axis 19, with the beam being focused by the geometry of the cathode 1.

In order to deflect the electron beam, i.e. in order to impart a mean direction thereto different from the emission axis 19, it is sufficient to set up asymmetry in the electric field created around the filament 12 by applying voltages of different values to the metal parts 15 and 16, one of which values may be zero, but neither of which may be positive. A beam F' having an axis 19' can thus be obtained for a positive potential difference between the part 15 and the part 16; similarly, a beam F'' having an axis 19'' is obtained for a negative potential difference between the part 15 and the part 16.

The X-ray tube described above with reference to FIG. 1 provides satisfactory deflection performance without requiring high bias voltages to be applied to the metal parts 15 and 16. However, such an X-ray tube provides only one X-ray beam having determined energy characteristics. However, in some applications, two X-ray beams are required having different energy characteristics and capable of taking up various angular positions while retaining a determined width.

To this end, it is known to make cathodes having two filaments supplied with currents of different values. These filaments may be in axial alignment so as to use the same metal focusing parts, but this causes the point of impact of the electron beam on the target to be displaced along the filament axis and also changes the width of said point of impact.

In other embodiments, instead of being aligned in the same groove, the two filaments are disposed in respective parallel grooves separated by a metal partition. In this way, the point of impact of each electron beam is at a position in the longitudinal direction of the filaments which is substantially the same for both filaments. However, the position of the point of impact along a direction transverse to the said filament axis differs from one filament to the other, as does the concentration of the beam. In addition, it is difficult to obtain deflection of the beams using metal parts.

An object of the present invention is to provide a cathode for an X-ray tube including at least two filaments disposed in separate mutually parallel grooves and which enables each electron beam to be deflected while simultaneously controlling concentration thereof.

SUMMARY OF THE INVENTION

The invention provides an X-ray tube cathode including at least two filaments associated with an electron beam deflecting and focusing device, wherein said deflecting and focusing device comprises at least three metal parts which are electrically insulated from one another and raised to electrical voltages, a first metal part and a second metal part being associated with a first filament, while said second metal part and a third metal part are associated with a second filament.

The metal parts are raised to different electrical voltages which are zero or negative so-as to change the concentrations and the deflections of the electron beams.

The metal parts are separated by insulating partitions which are disposed level with respective filaments in planes parallel to the longitudinal axes of said filaments.

The metal part which separates the two filaments may include two portions separated by an insulating partition said two portions being raised to electrical voltages that are zero or negative relative to the voltages of the associated filaments.

The metal parts may, for example, be made of a material of the nickel or molybdenum type, or of an alloy including one of these materials. The insulating partitions may be made of alumina or other ceramic, for example.

The invention also provides a method of determining the electrical voltages to be applied to the metal parts associated with a filament, said method comprising the following operations:

performing a first set of measurements of the variations in the size f of the electron beam impact on the anode as a function of the voltage applied to one of the metal parts associated with the filament emitting said beam for different values of the voltage applied to the other metal part associated therewith;

performing a second set of measurements of the variations in the deflection δ of the electron beam over the anode as a function of the voltage applied to said metal part for the same values of the voltage applied to said other metal part associated therewith; and using the first and second sets of measurements to determine two sets of curves providing curves showing the variations in the dimension f of the impact and in the deflection δ of the electron beam as a function of the voltages applied to said metal parts.

BRIEF DESCRIPTION OF THE DRAWINGS

Embodiments of the invention are described by way of example with reference to the accompanying drawings, in which.

DETAILED DESCRIPTION

Figure 1:
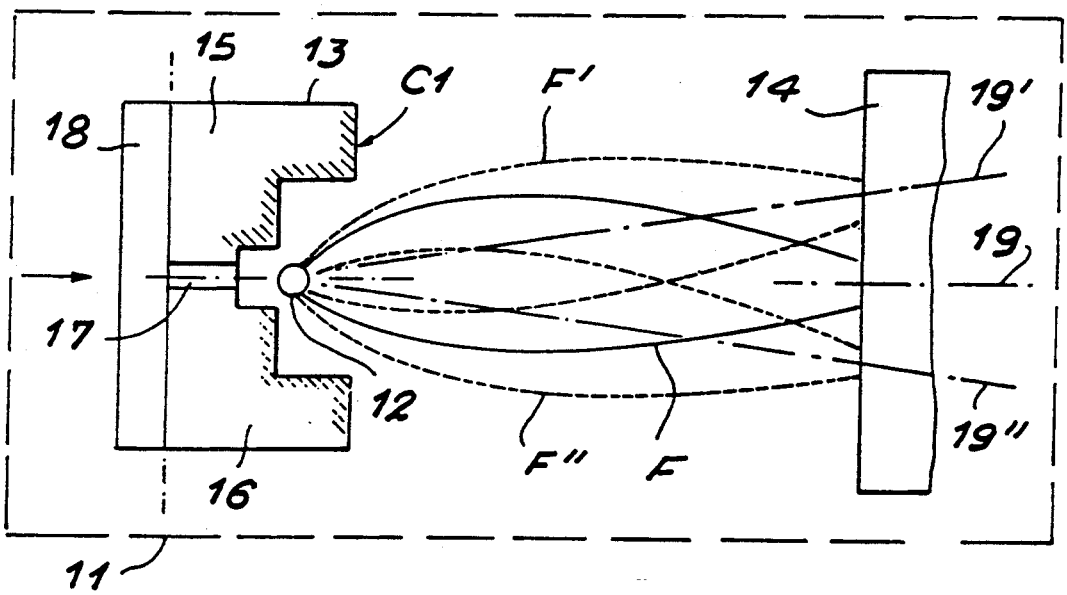
FIG. 1 (PRIOR ART)
FIG. 1 is a schematic view of a prior art X-ray tube.
Figure 2:
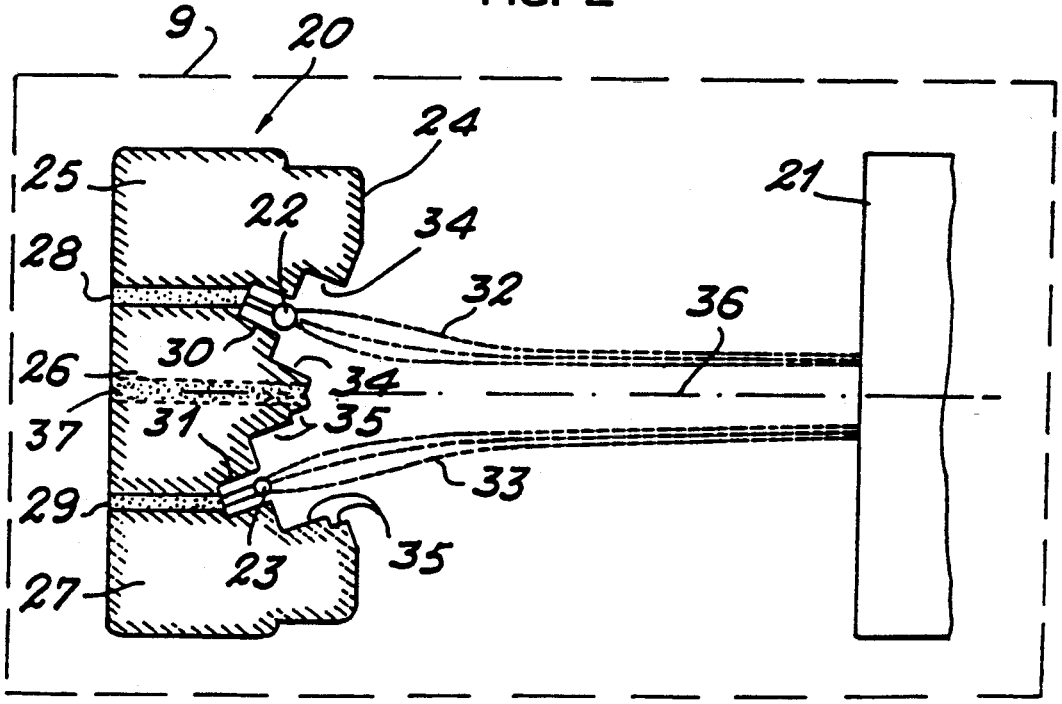
FIG. 2 is a schematic section view of an X-ray tube including a cathode of the present invention.

FIG. 2 is a schematic section view of an X-ray tube in accordance with the present invention. It comprises, inside a vacuum enclosure represented by dashed outline 9, a cathode 20 and an anode 21. The cathode 20 has two emitting filaments 22 and 23 disposed in a focusing device 24. The focusing device is constituted, when there are two filaments, by three metal parts 25, 26, and 27 which are stuck together but electrically insulated from one another by insulating partitions 28 and 29. The filament 22 is disposed in a groove 30 constituted by cutting out the parts 25 and 26 to a special shape around the insulating partition 28. Similarly, the filament 23 is disposed in a groove 31 which is made by cutting out the parts 26 and 27 specially around the insulating zone 29.

Each pair of adjacent metal parts 25, 26 or 26, 27 constitutes a focusing and deflecting device for an electron beam 32 or 33 emitted by the associated filament 22 or 23, and to this end each pair of said parts has a special cut-out shape for obtaining faces 34 or 35 disposed in a staircase configuration on either side of the associated filament 22 or 23.

The insulating partitions 28 and 29 open out respectively into the middles of the grooves 30 and 31, and they are disposed, for example, in planes parallel to the longitudinal axes of the associated filaments 22 and 23.

The metal parts 25, 26, and 27 are made of nickel or molybdenum, for example, whereas the insulating zones are made of alumina or other ceramic.

In order to concentrate and deflect each electron beam 32 or 33, electrical voltages $U_{25}$, $U_{26}$, and $U_{27}$ are applied to the parts 25, 26, and 27 respectively via conductors (not shown in FIG. 2). FIG. 2 also does not show the supply conductors for the filaments 22 and 23.

In order to determine the voltages to be applied to the metal parts 25, 26 or 26, 27 for obtaining the desired deflection and concentration of a beam, it is necessary to calibrate the X-ray tube by varying $U_{25}$, $U_{26}$, and $U_{27}$.

A first calibration operation consists in measuring the width f of the point of impact of the electron beam on the anode 21, i.e. the width of the focus of the X-ray beam, as a function of the voltage $U_{25}$ and for different values of $U_{26}$. Curves 40 to 43 of FIG. 3*a* are obtained, which curves correspond respectively to $U_{26}=0$ volts, $-100$ volts, $-200$ volts, and $-300$ volts.

A second calibration operation consists in measuring the deflection δ of the electron beam, i.e. the displacement of its point of impact on the anode 21 relative to a median axis or plane 36 as a function of the potential $U_{25}$ and for the same values of $U_{26}$. Curves 44 to 47 of FIG. 3*b* are obtained, which curves correspond respectively to $U_{26}=0$ volts, $-100$ volts, $-200$ volts, and $-300$ volts.

Figure 3A:
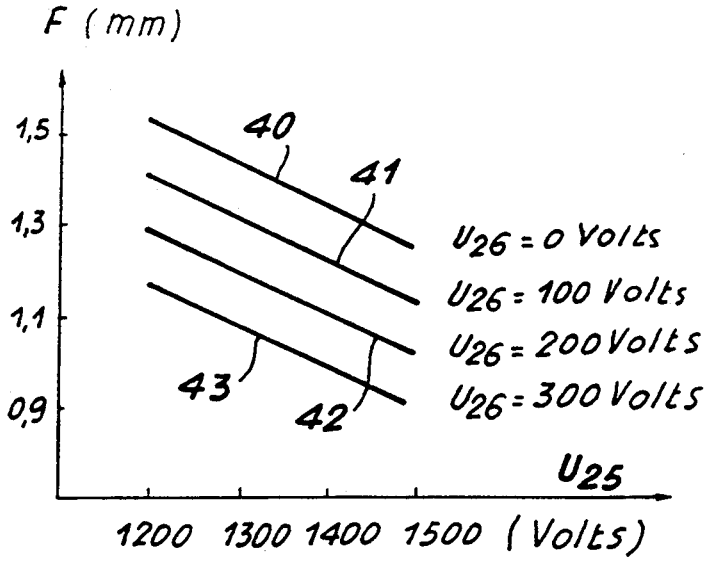
FIGS. 3*a*, 3*b*, and 3*c* are graphs for determining the voltages to be applied to the parts of the deflecting and focusing device.
Figure 3B:
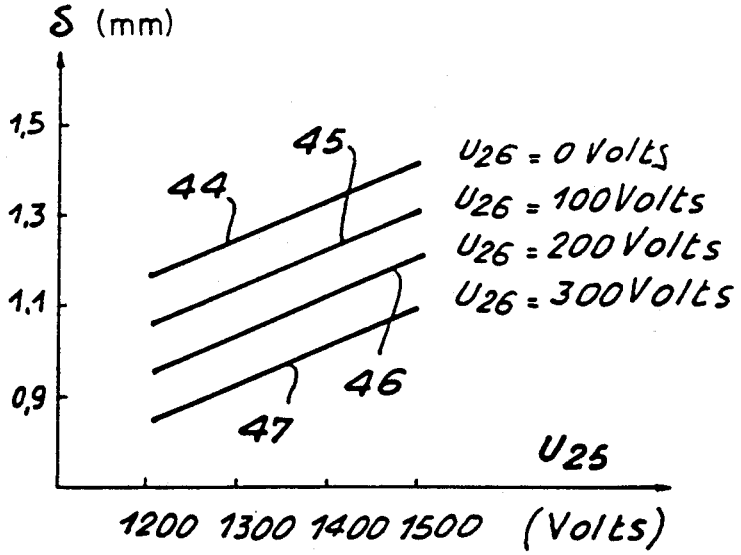
Figure 3C:
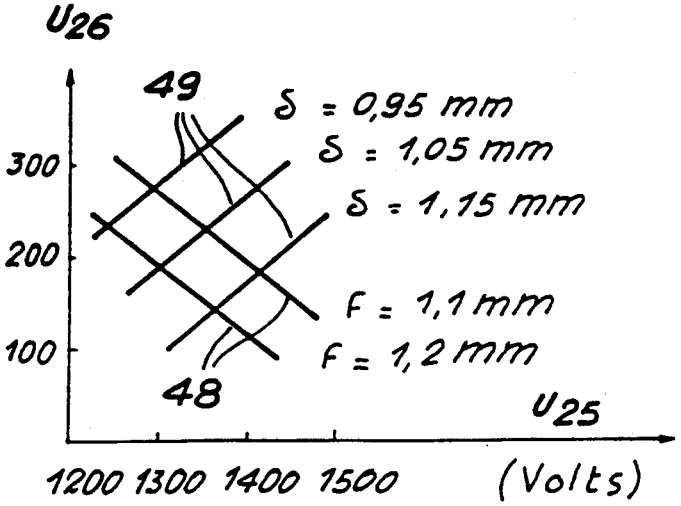

By combining the curves of FIGS. 3*a* and 3*b*, it is possible to obtain two sets of curves as shown in FIG. 3*c*, i.e. $U_{26}$ as a function of $U_{25}$ for different values of the width f of the point of impact (set 48) and for different values of beam deflection δ (set 49). In FIG. 3*c*, the coordinates of the point of intersection of the curves in the two grids 48 and 49 indicate the values of $U_{25}$ and $U_{26}$ required for obtaining the focus width and deflection indicated by the intersecting curves.

Naturally, the above-described calibration operations also need to be performed for the beam controlled by the parts 26 and 27.

The invention has been described with reference to a beam deflection and concentration device including three metal parts 25, 26, 27 separated by two insulating partitions 28 and 29. However, the invention may be performed using a focusing device similar to that described but in which the central part 26 is split into two parts separated by an insulating partition 37, as shown in dashed lines on FIG. 2.

This insulating partition is disposed in a plane parallel to the longitudinal axes of the filaments 22 and 23, e.g. the median plane 36.

Further, the invention may be implemented with a number of filaments greater than two and disposed in parallel grooves, each groove being associated with an insulating partition so as to insulate the metal parts on either side of each groove from each other.

Figure 4A:
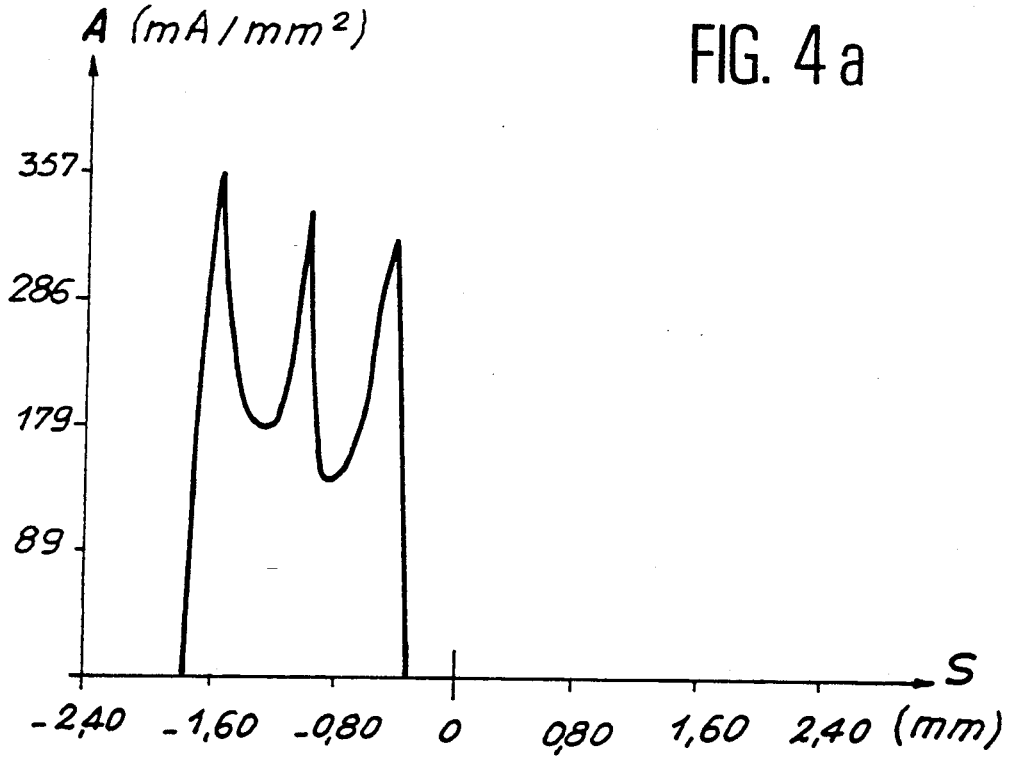
FIGS. 4*a* and 4*b* are graphs showing the deflection of a electron beam and its energy distribution in an X-ray tube according to the invention.
Figure 4B:
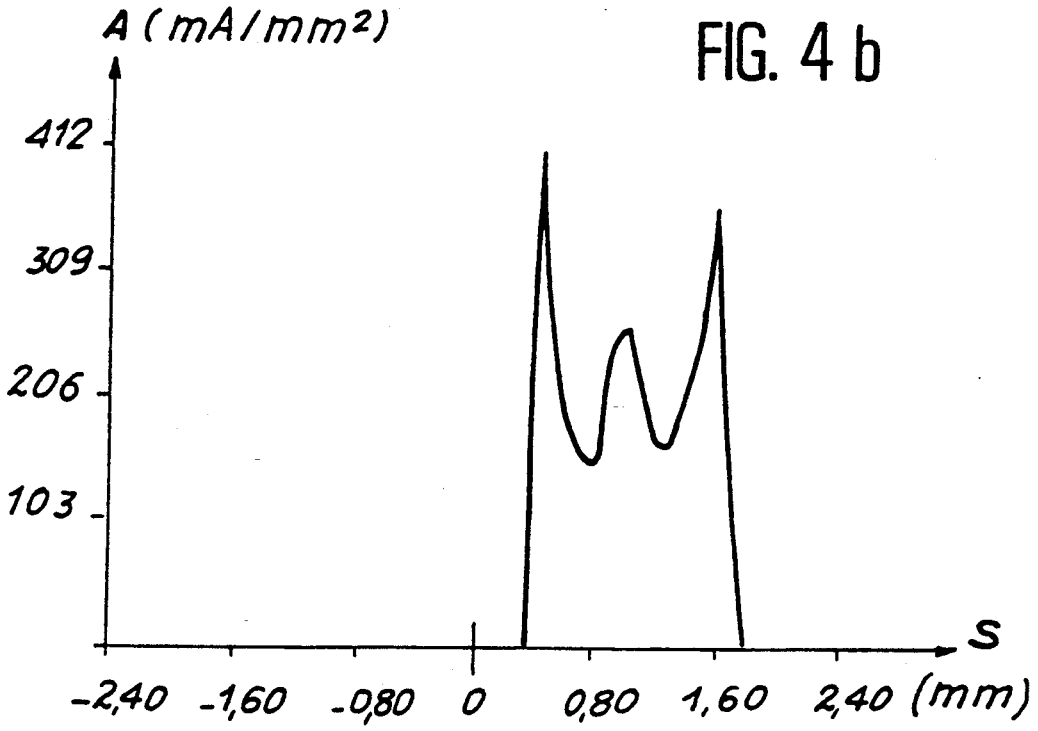

FIGS. 4*a* and 4*b* are graphs showing the density A of energy distribution at the point of impact of the electron beam on the anode as a function of distance S of the impact from the axis 36, said deflections being obtained using an X-ray tube having a cathode according to the invention. These graphs show that the beam may be deflected on either side of the axis 36 while maintaining good energy distribution in the beam.

We claim:

1. An x-ray tube cathode having at least two filaments associated with an electron beam deflecting and focusing device, said electron base deflecting and focusing device comprising:

at least three metal parts each raised to a respective voltage, a first and second metal part associated with a first filament and the second and a third metal part associated with a second filament; and a first and second insulating portion solely in a plane parallel to a longitudinal axis of said first and second filaments, said first insulating portion electrically insulating said first metal part from said second metal part, said second insulating portion electrically insulating said second metal part from said third metal part.

2. A cathode according to claim 1, wherein said first, second and third metal parts are raised to different voltages, said voltages being less than or equal to zero relative to said first and second filaments respectively for modifying a concentration and a deflection of emitted electron beams.

3. A cathode according to claim 1, wherein said first, second and third metal parts are made of one of nickel, molybdenum, and an alloy of these metals.

4. A cathode according to claim 1, wherein said first and second insulation portions are made of one of alumina and other ceramic.

5. An X-ray tube including a cathode according to claim 1.

6. An x-ray tube cathode having at least two filaments associated with an electron beam deflecting and focusing device, said electron beam deflecting and focusing device comprising:

at least three metal parts each raised to a respective voltage, a first and second metal part associated with a first filament and the second and a third metal part associated with a second filament, said second metal part being separated into a first and second metal sub-part;

a first and second insulating portion solely in a plane parallel to a longitudinal axis of said first and second filaments, said first insulating portion electrically insulating said first metal part from said second metal part, said second insulating portion electrically insulating said second metal part from said third metal part; and a third insulating portion for electrically insulating said first metal sub-part form said second metal sub-part.

7. An x-ray tube cathode having at least two filaments associated with an electron beam deflecting and focusing device, said electron beam deflecting and focusing device comprising:

at least three metal parts each raised to a respective voltage, a first and second metal part associated with a first filament and the second and a third metal part associated with a second filament, said second metal part being separated into a first and second metal sub-part; and a first, second, and third insulating portion solely in a plane parallel to a longitudinal axis of said first and second filaments, said first insulating portion electrically insulating said first metal part from said second metal part, said second insulating portion electrically insulating said second metal part from said third metal part, said third insulating portion for electrically insulating said first metal sub-part form said second metal sub-part.

* * * * *

UNITED STATES PATENT AND TRADEMARK OFFICE

CERTIFICATE OF CORRECTION

PATENT NO. : 5,224,143

DATED : June 29, 1993

INVENTOR(S) : Dumitrescu et al

It is certified that error appears in the above-indentified patent and that said Letters Patent is hereby corrected as shown below:

On title page, item [57], line 6, after "metal" delete ","

Col. 2, line 47, change "so-as" to --so as--

Signed and Sealed this

Nineteenth Day of September, 1995

*Attest:*

*Attesting Officer*

Bruce Lehman

BRUCE LEHMAN

*Commissioner of Patents and Trademarks*